US011865602B2

(12) United States Patent
White et al.

(10) Patent No.: US 11,865,602 B2
(45) Date of Patent: Jan. 9, 2024

(54) PAINTLESS DENT REMOVAL TOOL, SYSTEM AND METHOD

(71) Applicant: EHC INC., Oklahoma City, OK (US)

(72) Inventors: Chris White, Oklahoma City, OK (US); Jonathan Vandenfontyne, Brussels (BE); Reggie Ayers, Oklahoma City, OK (US); William J Bickel, Jr., Oklahoma City, OK (US)

( * ) Notice: Subject to any disclaimer, the term of this patent is extended or adjusted under 35 U.S.C. 154(b) by 196 days.

(21) Appl. No.: 17/150,022

(22) Filed: Jan. 15, 2021

(65) Prior Publication Data

US 2021/0220890 A1 Jul. 22, 2021

Related U.S. Application Data

(60) Provisional application No. 62/962,053, filed on Jan. 16, 2020.

(51) Int. Cl.
*B21D 1/08* (2006.01)

(52) U.S. Cl.
CPC ..... *B21D 1/08* (2013.01)

(58) Field of Classification Search
CPC ... B21D 1/06; B21D 1/08; B21D 1/10; B21D 1/12; A01B 1/00; B25G 1/102; Y10T 16/469; Y10T 16/476
See application file for complete search history.

(56) References Cited

U.S. PATENT DOCUMENTS

| | | | | |
|---|---|---|---|---|
| 5,313,735 | A * | 5/1994 | Latouche | A01K 87/08 16/427 |
| 5,479,804 | A | 1/1996 | Cook | |
| 5,716,987 | A * | 2/1998 | Wille | A61K 31/192 514/557 |
| 6,014,885 | A | 1/2000 | Griffaton | |
| 6,722,179 | B1 | 4/2004 | Ventura | |
| 6,957,561 | B1 | 10/2005 | Contreras | |
| 9,669,442 | B1 | 6/2017 | Alvarez | |
| 9,757,782 | B2 | 9/2017 | Wilkinson | |
| 9,868,143 | B2 | 1/2018 | Zimmerman | |
| 9,889,483 | B1 | 2/2018 | Allen | |
| 9,999,912 | B2 * | 6/2018 | Schaechinger | B21D 1/12 |
| 10,245,629 | B1 | 4/2019 | Skelton et al. | |
| 10,252,308 | B2 | 4/2019 | Hummert | |
| 2004/0134255 | A1 * | 7/2004 | Satterlee | B21D 1/06 72/479 |
| 2017/0120316 | A1 * | 5/2017 | Hummert | B21D 1/06 |
| 2020/0269301 | A1 * | 8/2020 | Hopf | B21D 1/06 |

* cited by examiner

*Primary Examiner* — David P Bryant
*Assistant Examiner* — Christine Bersabal
(74) *Attorney, Agent, or Firm* — D. Ward Hobson

(57) ABSTRACT

A paintless dent removal system, tool and method is disclosed. The handle assembly includes an ergonomic grip having a top, a bottom and an exterior profile. The handle assembly includes a detachable tool connector for detachably connecting a paintless dent removal tool to the handle assembly. The detachable tool connector detachably connected to the exterior profile of the ergonomic grip. The handle assembly further includes an adjustable paddle detachably connected to the bottom of the ergonomic grip. The adjustable paddle having a blade, a shaft and a tip. The blade configured to support a user's forearm during use and the tip detachably connected to the bottom of the ergonomic grip.

2 Claims, 5 Drawing Sheets

PAINTLESS DENT REMOVAL TOOL, SYSTEM AND METHOD

CROSS REFERENCE TO RELATED APPLICATIONS

This application claims priority to U.S. Provisional Application No. 62/962,053 filed on Jan. 16, 2020, which is expressly incorporated herein by reference in its entirety.

FIELD OF INVENTION

The Invention Is in the technical field of paintless dent removal systems, tools and methods. The invention pertains generally to an improved handle assembly and method of use. The improved handle assembly is configured to be used with a variety of paintless dent removal tools, including but not limited to, paintless dent removal tools used to "pull-out" or "push-out" a dent in the outer body of a vehicle, such as an automobile, aircraft, motorcycle and the like, for example. The improved handle assembly is configured to be modular such that component parts of the handle assembly may be detachably connected to one another to fit a variety of different sized and shaped users. Further, the modular nature of the improved handle assembly permits users to "pull-out" or "push-out" a variety of different sized and shaped dents with less user fatigue and discomfort than traditional paintless dent removal tools. In addition, the improved handle assembly permits users to detachably connect a variety of improved paintless dent removal tools that were traditionally not feasible due to the physical constraints of existing paintless dent removal tools. For example, paintless dent removal tools with longer necks, twisted necks or curved necks. The improved paintless dent removal handle assembly and improved detachably connected paintless dent removal tools are configured to be used together as an interchangeable system.

BACKGROUND

Advancements in construction methods and materials have resulted in lighter and stronger vehicle bodies for automobiles, aircrafts, motorcycles and the like. However, such improved vehicle bodies are often increasingly prone to dents, dings and various other body deformations. Such damage may be caused by, for example, automobile accidents or debris striking the outer surface of the vehicle body. Repairing such dents, dings and deformations can be difficult, laborious and time consuming, even when using traditional paintless dent removal tools and processes.

In general, paintless dent removal is the process of repairing dents to the body of a vehicle body without repainting the vehicle. Thus, saving the owner of the vehicle time and money by avoiding the cost and expense of repainting the vehicle. Traditionally, in paintless dent removal, many repair shops utilize the flexibility and durability of the outer surface of the vehicle body to reach into vehicle body compartments to "push-out" a dent from the inside outward or "pull-out" a dent from the outside of the vehicle body. Once the dent is pushed or pulled out, there is also a need to partially "knock-down" or flatten the dent to smooth-out the outer surface of the vehicle body to completely remove the dent.

Traditionally, repair shops have used a variety of tools to help assist a user with the paintless dent repair process, including tools designed to assist a user with the "push-out" and "pull-out" process and tools designed to assist a user with the "knock-down" process, for example. Unfortunately, however, such traditional tools are inefficiently configured, difficult to use and difficult to control. Thus, decreasing their usefulness and increasing the overall cost of the paintless dent repair process. Further, many traditional paintless dent removal tools are not modular or configured to be interconnected with a variety of different sized or shaped paintless dent removal tools to form a system. To that end, it would be advantageous to provide an improved paintless dent removal system and tools, including an improved ergonomic handle assembly for use with a variety of traditional paintless dent removal tools as well as use with improved paintless dent removal tools as described and claimed herein. For example, improved paintless dent removal tools with longer necks, twisted or curved necks that were previously not feasible due to the physical constraints of traditional paintless dent removal tools and user fatigue and discomfort. The improved handle assembly is configured to reduce fatigue and strain on the wrist, increase the force being applied by a person, increase the control of the force being applied, provide for adjustments for user size and angle and is adapted for use with a wide variety of paintless dent removal tools, including traditional paintless dent removal tools and improved paintless dent removal tools, such as described above. Thereby, increasing the safety and effectiveness of the paintless dent repair process and reducing the cost of the paintless dent repair process.

SUMMARY OF THE INVENTION

The inventive concepts disclosed herein are generally directed to an improved paintless dent removal system, tools and methods of use, including an improved handle assembly. In some embodiments, the handle assembly generally includes an ergonomic grip having a top, a bottom and an exterior profile. Wherein, at least a portion of the exterior profile of the ergonomic grip includes one or more depressions spatially arranged in a series along a portion of the exterior profile of the ergonomic grip and configured to be gripped by a person. The handle assembly also includes a detachable tool connector for detachably connecting a paintless dent removal tool to the handle assembly. The detachable tool connector detachably connected to the exterior profile of the ergonomic grip. The handle assembly further includes an adjustable paddle detachably connected to the bottom of the ergonomic grip. The adjustable paddle having a blade, a shaft and a tip. The blade configured to support a user's forearm during use. The tip detachably connected to the bottom of the ergonomic grip. In some embodiments, the handle assembly further includes a paintless dent removal tool detachably connected to the detachable tool connector. Further, in some embodiments, the adjustable paddle of the handle assembly is configured to extend from a stowed position to a deployed position so as to be adjustable for different sized and shaped users and to permit use of improved paintless dent removal tools, such as improved tools with longer necks, twisted necks or curved necks, for example. Such improved paintless dent removal tools were not previously feasible due to the physical constraints of traditional paintless dent removal tools and user fatigue and discomfort.

A method of removing a dent from a vehicle is also disclosed. In some embodiments, the method generally includes the step of providing a handle assembly for a paintless dent removal tool. The handle assembly including an ergonomic grip having a top, a bottom and an exterior profile. Wherein at least a portion of the exterior profile of the ergonomic grip includes one or more depressions spatially arranged in a series along a portion of the exterior profile of the ergonomic grip and configured to be gripped by a person. The handle assembly includes a detachable tool connector for detachably connecting a paintless dent removal tool to the handle assembly. The detachable tool connector detachably connected to the exterior profile of the ergonomic grip. The handle assembly further including an adjustable paddle detachably connected to the bottom of the ergonomic grip. The adjustable paddle having a blade, a shaft and a tip. The blade configured to support a user's forearm during use and the tip detachably connected to the bottom of the ergonomic grip. The method further including the step of connecting a paintless dent removal tool to the detachable tool connector of the handle assembly and the step of using the paintless dent removal tool to remove a dent from the surface of a vehicle body.

The handle assembly and methods of use thereof provide numerous advantages and unexpected results over traditional paintless dent removal tools. The improved handle assembly is configured to increase safety, reduce strain on the wrist, increase the force being applied by a person, increase the control of the force being applied, provide for adjustments for user size and angle and is adapted for use with a wide variety of paintless dent removal tools. Thereby, permitting the user to detachably connect a variety of improved paintless dent removal tools with longer necks, twisted necks, or curved necks that were not previously feasible due to the physical constraints of traditional paintless dent removal tools and user fatigue and discomfort. Thereby, increasing safety and effectiveness and reducing the cost of the paintless dent removal process.

It is to such an improved paintless dent removal system, tools and handle assembly and to methods of using thereof that exemplary embodiments of the inventive concepts disclosed and claimed herein are directed.

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1:
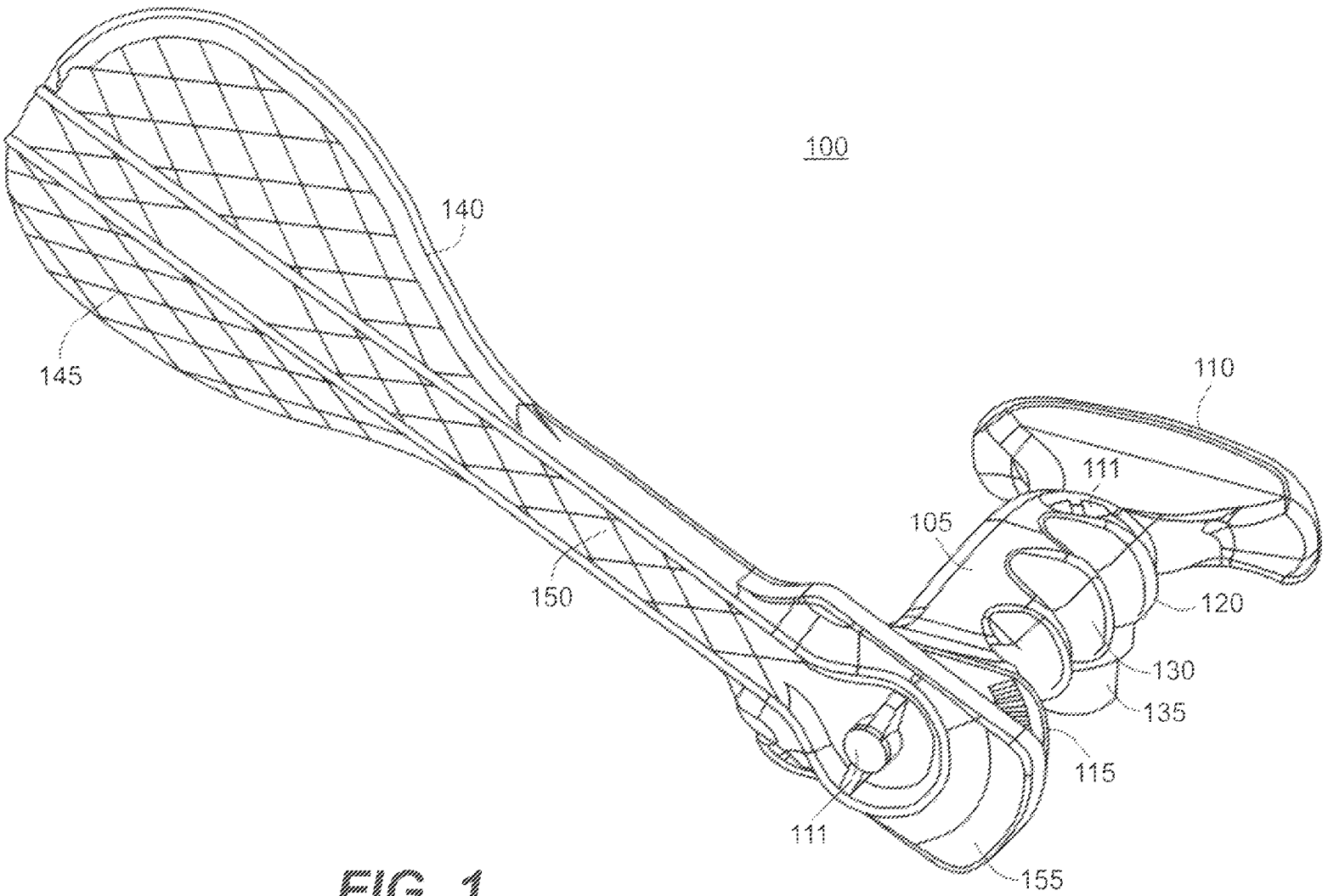
FIG. 1 is a perspective view of an exemplary embodiment of the handle assembly (100) in accordance with the inventive concepts disclosed herein.

Before explaining at least one embodiment of the inventive concepts disclosed herein in detail, it is to be understood that the inventive concepts are not limited in their application to the details of construction and the arrangements of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements out may include other elements not expressly listed.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
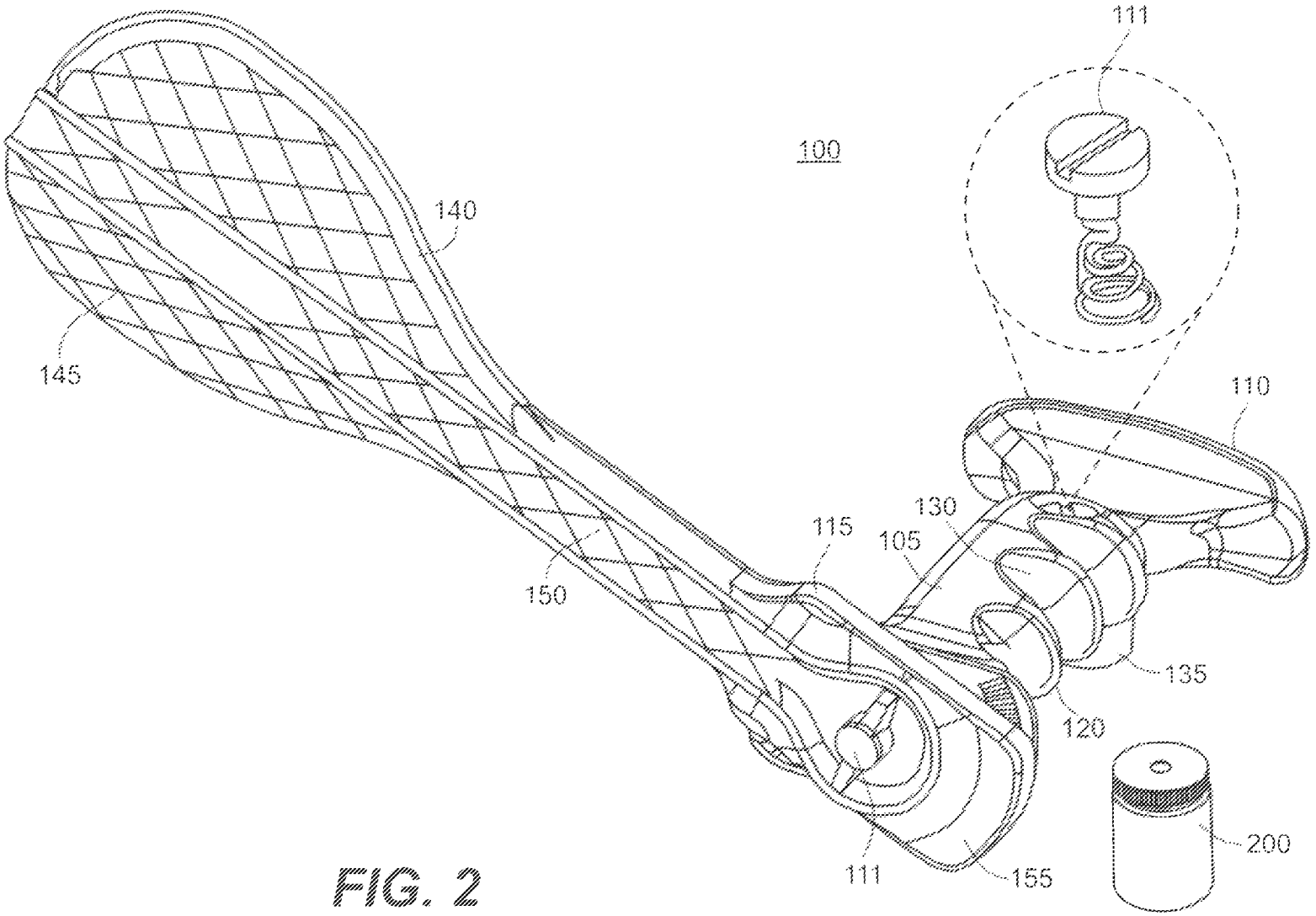
FIG. 2 is a perspective view of an embodiment of the handle assembly (100) in accordance with the inventive concepts disclosed herein.
Figure 3:
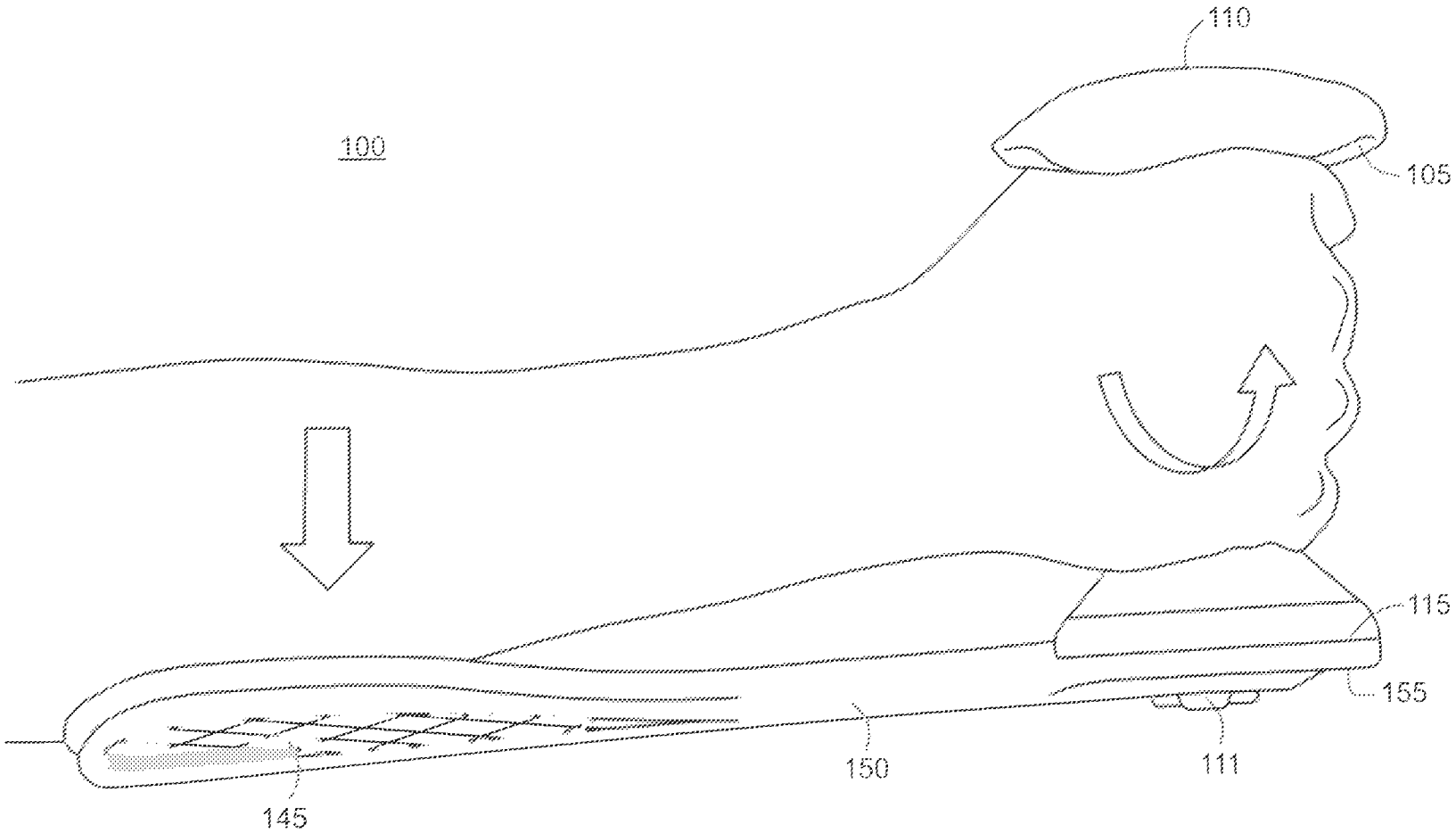
FIG. 3 is a perspective view of an embodiment of the handle assembly (100) in accordance with the inventive concepts disclosed herein.

Referring now to FIGS. 1-3, shown therein is a perspective view of an exemplary embodiment of a handle assembly (100) for a paintless dent removal tool (200) in accordance with the inventive concepts disclosed herein. The handle assembly (100) includes an ergonomic grip (105) having a top (110), a bottom (115) and an exterior profile (120). Wherein at least a portion of the exterior profile (120) of the ergonomic grip (105) includes one or more depressions (130) spatially arranged in a series along a portion of the exterior profile (120) of the ergonomic grip (105) includes one or more depressions (130) spatially arranged in a series along a portion of the exterior profile (120) of the ergonomic grip (105) and configured to be gripped by a person. The handle assembly (100) includes a detachable tool connector (135) for detachably connecting a paintless dent removal tool (200) to the handle assembly (100). The detachable tool connector (135) detachably connected to the exterior profile (120) of the ergonomic grip (105). The handle assembly (100) further including an adjustable paddle (140) detachably connected to the bottom (115) of the ergonomic grip (105). The adjustable paddle (140) having a blade (145), a shaft (150) and a tip (155). The blade (145) configured to support a user's forearm during use and the tip (155) detachably connected to the bottom (115) of the ergonomic grip (105). In some embodiments, the handle assembly (100) further includes a paintless dent removal tool (200) detachably connected to the detachable tool connector (135). The various components parts of the handle assembly for the paintless dent removal tool, system, and method described and claimed herein and as shown in the Figures, are configured to be detachably connected to one another by means of one or more connector (111). The connector (111) includes any connecting means known in the art, including but not limited to, fasteners, anchors, screws, pins bolts, covers, latches, locks or the like.

The handle assembly (100) may be constructed from any material of sufficient strength necessary to maintain the structural integrity of the paintless dent repair tool (200) when in use. For example, the handle assembly (100) may be constructed from non-metals such as plastics, polycarbonate, impact resistant nylon, carbon fiber, polymers, resins, ceramics, composite materials and the like or metals and alloys, including steel, titanium, iron combinations thereof and the like. Further, it should be understood that the various components of the handle assembly (100) may each be constructed from the same or different materials, combinations thereof and the like for example. The handle assembly (100) is shown has having a generally "L" shape. It should be understood, however, that the handle assembly (100) may have any desired shape, including but not limited to, a generally rectangular or circular shape for example. Further, in some embodiments the handle assembly (100), or the various components thereof, may include reinforcing or bracing structures, such as struts, ribs, braces, rods or any other suitable reinforcing structure or combinations thereof.

The ergonomic grip (105) has a top (110), a bottom (115) and an exterior profile (120). Wherein, at least a portion of the exterior profile (120) of the ergonomic grip (105) includes one or more depressions (130) spatially arranged in a series along a portion of the exterior profile (120) of the ergonomic grip (105) and is configured to be gripped by a person. The one or more depressions (130) are spatially arranged in a series so as to be complementary to the grip of a person.

The ergonomic grip (105) may be constructed from any material of sufficient strength necessary to maintain the structural integrity of the handle assembly (100) and the paintless dent repair tool (200) when in use. For example, the ergonomic grip (105) may be constructed from non-metals such as plastics, rubber, polycarbonate, impact resistant nylon, carbon fiber, polymers, resins, ceramics, composite materials and the like or metals and alloys, including steel, titanium, iron, combinations thereof and the like. Further, it should be understood that the various components of the ergonomic grip (105) may each be constructed from the same or different materials, combinations thereof and the like.

The ergonomic grip (105) is shown as having a generally rectangular shape. It should be understood, however, that the ergonomic grip (105) may have any desired shape, including but not limited to, a generally square or circular shape, for example. Further, each component of the ergonomic grip (105) may have the same or different shape, including but not limited to a circular, triangular or rectangular shape for example.

The exterior profile (120) of the ergonomic grip (105) is configured to generally fit the grip of a person's hand such that a person's fingers fall into the one or more depressions (130) that are spatially arranged in a series along a portion of the exterior profile (120). The one or more depressions (130) are spatially arranged in a series in a similar configuration to that of the grip of a person such that function is increased between the hand of a person and the exterior profile (120). The ergonomic profile (120) is configured to increase safety and efficiency by reducing the probability of discomfort, fatigue or trauma to the hand, finger wrist or arm of a user by being configured to the general shape of a user's fingers and palm. Thereby permitting a user to more securely grip the paintless dent repair tool (200), decrease fatigue and increase safety and productivity. To ensure a secure grip on a paintless dent repair tool, sufficient friction between the hand the and the handle assembly (100) is required. This is particularly important when significant force must be applied, such as during the paintless dent removal process and when using a paintless dent repair tool (200). The exterior profile (120) may be configured with non-slip, non-conductive and compressible materials configured for comfort and to increase friction between the hand and the handle assembly (100), thereby increasing efficiency, reducing fatigue, and improving safety.

The detachable tool connector (135) is used for detachably connecting a paintless dent removal tool (200) to the handle assembly (100). The detachable tool connector (135) is detachably connected to the exterior profile (120) of the ergonomic grip (105). The detachable tool connector (135) may be configured to accept the handle of a variety of paintless dent removal tools. For example, the detachable tool connector (135) may be configured to accept a handle of a paintless dent removal tool such as "push" tool that is commonly used to push dents out of the surface of a vehicle. The handle of a traditional paintless dent removal tool may be inserted into the detachable tool connector (135) and connected thereto by any mechanism known in the art, including but not limited to, fasteners, anchors, screws, pins, bolts, covers, latches, locks or the like. Once the paintless dent removal tool is secured into place by means of the detachable tool connector (135), a user may apply pressure to the ergonomic grip (105) and manipulate the paintless dent removal tool using increased leverage and improved grip. Thereby, increasing the safety of the paintless dent removal tool being used and increasing the efficiency and safety of the paintless dent repair process.

Further, the detachable tool connector (135) may be used to detachably connect improved paintless dent removal tools having longer necks, twisted necks or curved necks that were not previously feasible due to the physical constraints of traditional paintless dent removal tools and traditional handle assemblies. Such improved paintless dent removal tools are configured to be detachably connected to the detachable tool connector (135) to form a system of interchangeable tools and component parts that be used with a variety of different sized and shaped users and different sized and shaped dents. Thereby increasing the efficiency and safety of the paintless dent repair process. The improved paintless dent removal tools may be constructed from a variety of materials, including but noted limited to steel, plastics, carbon fiber and the like, for example.

The detachable tool connector (135) may be constructed from any material of sufficient strength necessary to maintain the structural integrity of the handle assembly (100) and the paintless dent repair tool (200) when in use. For example, the detachable tool connector (135) may be constructed from non-metals such as plastics, rubber, polycarbonate, impact resistant nylon, carbon fiber, polymers, resins, ceramics, composite materials and the like or metals and alloys, including steel, titanium, iron, combinations thereof and the like. Further, it should be understood that the various components of the detachable tool connector (135) may each be constructed from the same or different materials, combinations thereof and the like.

The detachable tool connector (135) is shown as having a generally circular shape. It should be understood, however, that the detachable tool connector (135) may have any desired shape, including but not limited to, a generally square or triangular shape, for example. Further, each component of the detachable tool connector (135) may have the same or different shape, including but not limited to a circular, triangular or rectangular shape for example.

The handle assembly (100) further includes an adjustable paddle (140). The adjustable paddle (140) is detachably connected to the bottom (115) of the ergonomic grip (105). The adjustable paddle (140) has a blade (145), a shaft (150) and a tip (155). The blade (145) is configured to support a user's forearm during use and the tip (155) is detachably connected to the bottom (115) of the ergonomic grip (105). The blade (145) is shown as having a fan shape sufficient to support the forearm and elbow of a user. The blade (145) is configured to provide a user with increased leverage and support when applying pressure to the ergonomic grip (105) to manipulate the paintless dent removal tool (200). In some embodiments, the blade (145) may be telescopically extended to a deployed position and telescopically retracted to a stowed position, so as to permit a user to manually adjust the length of the blade (145) to fit the size and shape of a particular user. In this way, the handle assembly (100) provides for increased comfort and improved safety during use. Thereby, increasing the safety and efficiency of the paintless dent repair process.

The adjustable paddle (140) may be constructed from any material of sufficient strength necessary to maintain the structural integrity of the handle assembly (100) and the paintless dent repair tool (200) when in use. For example, the adjustable paddle (140) may be constructed from non-metals such as plastics, rubber, polycarbonate, impact resistant nylon, carbon fiber, polymers, resins, ceramics, composite materials and the like or metals and alloys, including steel, titanium, iron, combinations thereof and the like. Further, it should be understood that the various components of the adjustable paddle (140) may each be constructed from the same or different materials, combinations thereof and the like. In some embodiments, the adjustable paddle (140) may also include ribs, rods or bracing structures for additional strength.

The adjustable paddle (140) is shown as having a generally rectangular shape. It should be understood, however, that the adjustable paddle (140) may have any desired shape, including but not limited to, a generally square or circular shape, for example. Further, each component of the adjustable paddle (140) may have the same or different shape, including but not limited to a circular, triangular or rectangular shape for example.

Figure 4:
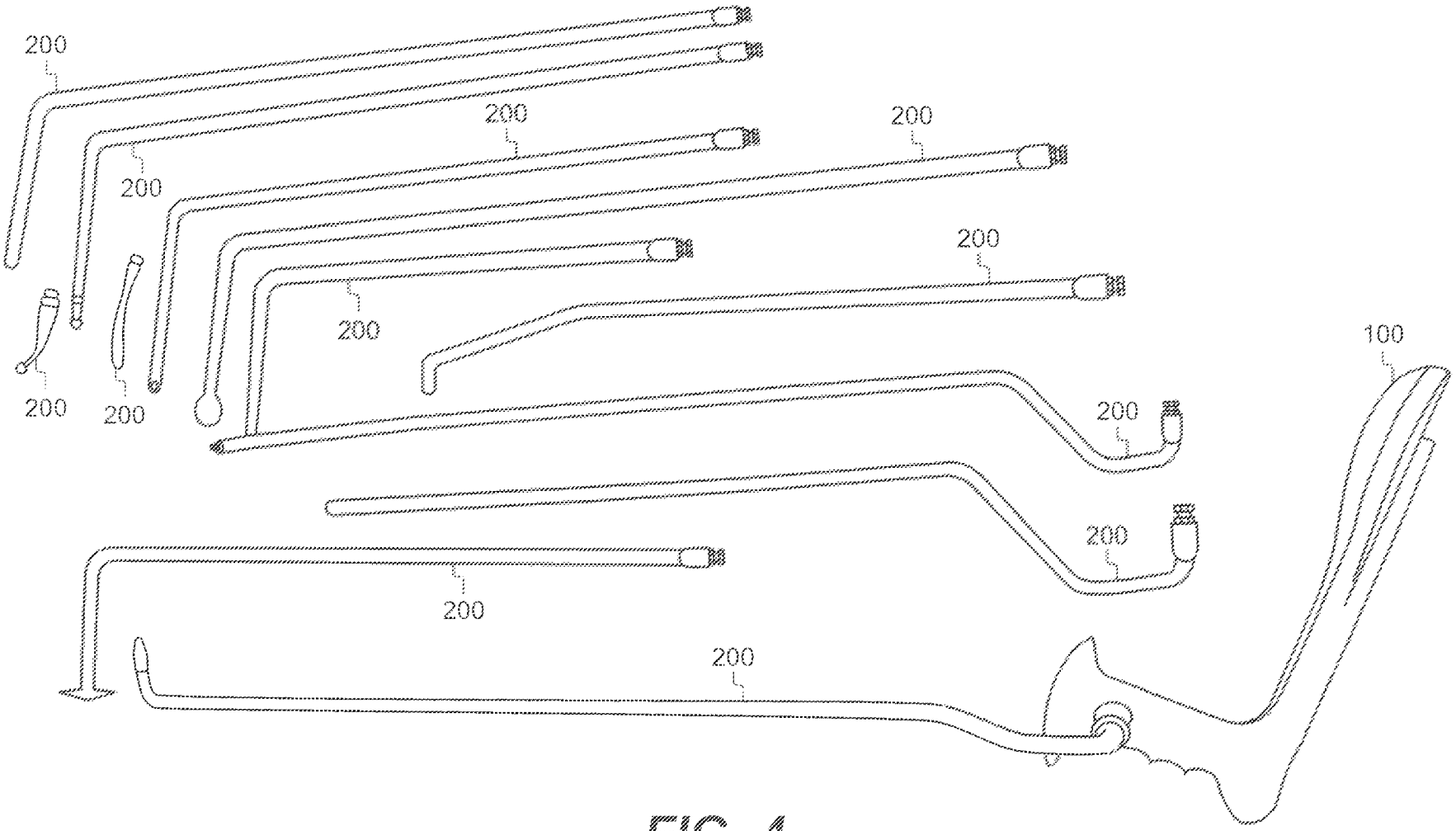
FIG. 4 is a perspective view of a paintless dent removal tool (200) in accordance with the inventive concepts disclosed herein.

Referring now to FIG. 4, shown therein is a depiction of a variety of differently sized and shaped improved paintless dent removal tools (200). As depicted therein, the paintless dent removal tool (200) includes a handle with a side and two opposing ends. The paintless dent removal tool (200) having a rod with an extended, angled, curved or twisted portion. The length of the angle, twist or curve was not previously feasible due to physical constraints and user fatigue associated with use of traditional paintless dent removal tools. The handle assembly (100), due to its ergonomic shape permits users to use their shoulders and wrist with less fatigue and discomfort thereby permitting a user to use the paintless dent removal tool (200). In use, the handle assembly (100) is configured to be affixed to the paintless dent removal tool (200) to provide such tools with an ergonomic handle that can be adjusted to fit a variety of sized and shaped users so as to reduce fatigue and strain on the wrist, increase the force being applied by a person, increase the control of the force being applied, provide for adjustments for user size and angle and is adapted for use with a wide variety of paintless dent removal tools. Thereby, increasing the safety and effectiveness of the paintless dent repair process and reducing the cost of the paintless dent repair process. While FIG. 4 depicts a particular type of paintless dent removal tool, it should be understood that the handle assembly (100) is configured to be used with a variety of different size and shaped paintless dent removal tools, including but not limited to the paintless dent removal tool (200) depicted in FIG. 4.

Figure 5:
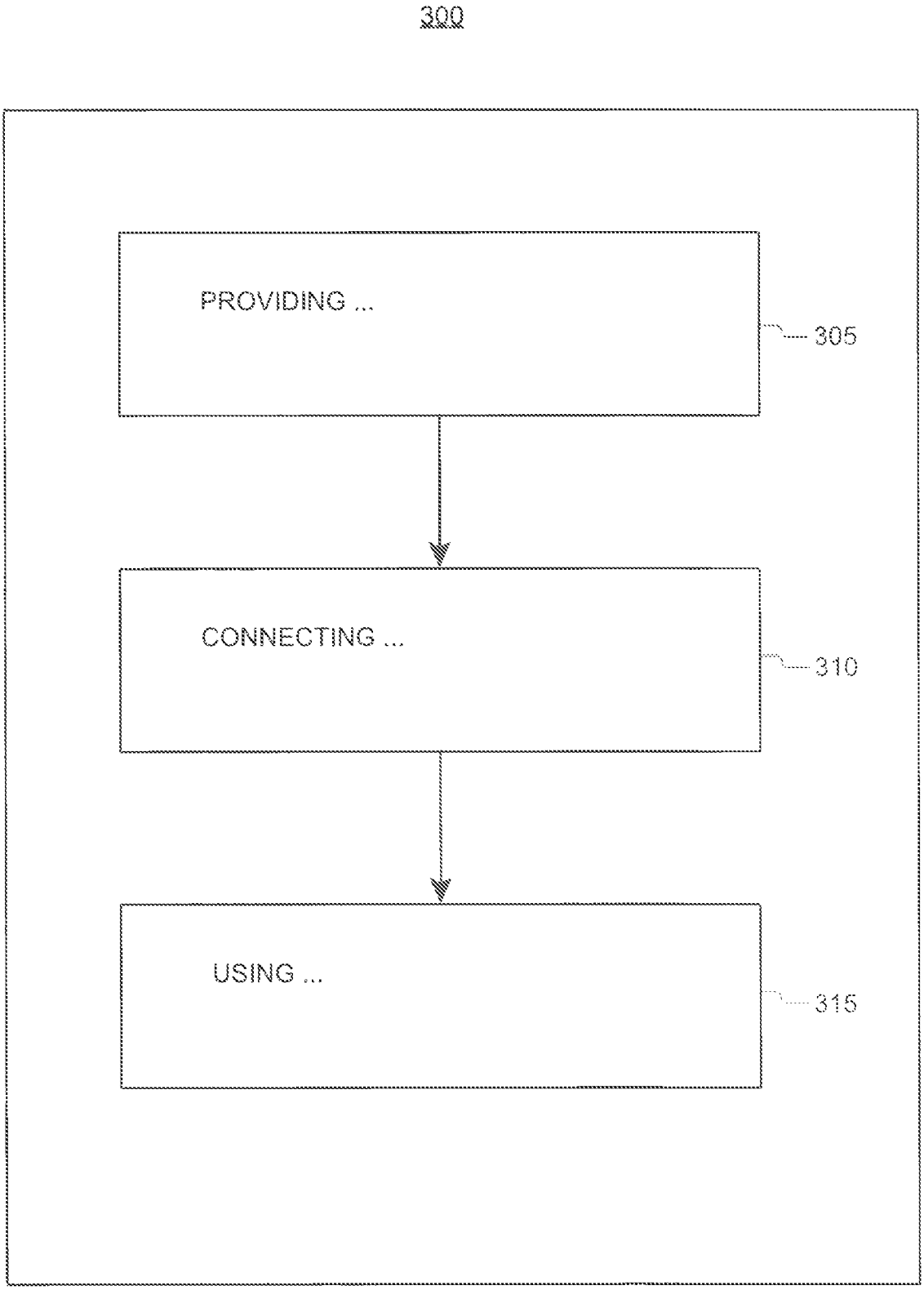
FIG. 5 is a diagram depicting a method (300) of removing a dent from a vehicle in accordance with the inventive concepts disclosed herein.

Referring now to FIG. 5, shown therein is a method (300) of removing a dent (192) from a vehicle. The method (300) includes the step of providing (305) a handle assembly (100) for a paintless dent removal tool (200). The handle assembly (100) including an ergonomic grip (105) having a top (110), a bottom (115) and an exterior profile (120). Wherein at least a portion of the exterior profile (120) of the ergonomic grip (105) includes one or more depressions (130) spatially arranged in a series along a portion of the exterior profile (120) of the ergonomic grip (105) and configured to be gripped by a person. The handle assembly (100) includes a detachable tool connector (135) for detachably connecting a paintless dent removal tool (200) to the handle assembly (100). The detachable tool connector (135) detachably connected to the exterior profile (120) of the ergonomic grip (105). The handle assembly (100) further includes an adjustable paddle (140) detachably connected to the bottom (115) of the ergonomic grip (105). The adjustable paddle (140) having a blade (145), a shaft (150) and a tip (155). The blade (145) configured to support a user's forearm during use and the tip (155) detachably connected to the bottom (115) of the ergonomic grip (105). The method (300) further including the step of connecting (310) a paintless dent removal tool (200) to the detachable tool connector (135) of the handle assembly (100) and the step of using (315) the paintless dent removal tool (100) to remove a dent (192) from the surface of a vehicle body.

The method includes the step of providing (3015) a handle assembly (100) for a paintless dent removal tool (200). The handle assembly (100) includes an ergonomic grip (105) having a top (110), a bottom (115) and an exterior profile (120). Wherein at least a portion of the exterior profile (120) of the ergonomic grip (105) includes one or more depressions (130) spatially arranged in a series along a portion of the exterior profile (120) of the ergonomic grip (105) and configured to be gripped by a person. The handle assembly (100) includes a detachable tool connector (135) for detachably connecting a paintless dent removal tool (200) to the handle assembly (100). The detachable tool connector (135) detachably connected to the exterior profile (120) of the ergonomic grip (105). The handle assembly (100) further includes an adjustable paddle (140) detachably connected to the bottom (115) of the ergonomic grip (105). The adjustable paddle (140) having a blade (145), a shaft (150) and a tip (155). The blade (145) configured to support a user's forearm during use and the tip (155) detachably connected to the bottom (115) of the ergonomic grip (105).

As discussed above, the handle assembly (100) may be constructed from any material of sufficient strength necessary to maintain the structural integrity of the paintless dent repair tool (200) when in use. For example, the handle assembly (100) may be constructed from non-metals such as plastics, polycarbonate, impact resistant nylon, carbon fiber, polymers, resins, ceramics, composite materials and the like or metals and alloys, including steel, titanium, iron combinations thereof and the like. Further, it should be understood that the various components of the handle assembly (100) may each be constructed from the same or different materials, combinations thereof and the like for example. The handle assembly (100) is shown has having a generally "L" shape. It should be understood, however, that the handle assembly (100) may have any desired shape, including but not limited to, a generally rectangular or circular shape for example. Further, in some embodiments the handle assembly (100), or the various components thereof, may include reinforcing or bracing structures, such as struts, ribs, braces, rods or any other suitable reinforcing structure or combinations thereof.

The ergonomic grip (105) has a top (110), a bottom (115) and an exterior profile (120). Wherein, at least a portion of the exterior profile (120) of the ergonomic grip (105) includes one or more depressions (130) spatially arranged in a series along a portion of the exterior profile (120) of the ergonomic grip (105) and is configured to be gripped by a person. The one or more depressions (130) are spatially arranged in a series so as to be complementary to the grip of a person.

The ergonomic grip (105) may be constructed from any material of sufficient strength necessary to maintain the structural integrity of the handle assembly (100) and the paintless dent repair tool (200) when in use. For example, the ergonomic grip (105) may be constructed from non-metals such as plastics, rubber, polycarbonate, impact resistant nylon, carbon fiber, polymers, resins, ceramics, composite materials and the like or metals and alloys, including steel, titanium, iron, combinations thereof and the like. Further, it should be understood that the various components of the ergonomic grip (105) may each be constructed from the same or different materials, combinations thereof and the like.

The ergonomic grip (105) is shown as having a generally rectangular shape. It should be understood, however, that the ergonomic grip (105) may have any desired shape, including but not limited to, a generally square or circular shape, for example. Further, each component of the ergonomic grip (105) may have the same or different shape, including but not limited to a circular, triangular or rectangular shape for example.

The exterior profile (120) of the ergonomic grip (105) is configured to generally fit the grip of a person's hand such that a person's fingers fall into the one or more depressions (130) that are spatially arranged in a series along a portion of the exterior profile (120). The one or more depressions (130) are spatially arranged in a series in a similar configuration to that of the grip of a person such that friction is increased between the hand of a person and the exterior profile (120). The ergonomic profile (120) is configured to increase safety and efficiency by reducing the probability of discomfort, fatigue or trauma to the hand, finger wrist or arm of a user by being configured to the general shape of a user's fingers and palm. Thereby permitting a user to more securely grip the paintless dent repair tool (200), decrease fatigue and increase safety and productivity. To ensure a secure grip on a paintless dent repair tool, sufficient friction between the hand the and the handle assembly (100) is required. This is particularly important when significant force must be applied, such as during the paintless dent removal process and when using a paintless dent repair tool (200). The exterior profile (120) may be configured with non-slip, non-conductive and compressible materials configured for comfort and to increase friction between the hand and the handle assembly (100), thereby increasing efficiency, reducing fatigue, and improving safety.

The detachable tool connector (135) is used for detachably connecting a paintless dent removal tool (200) to the handle assembly (100). The detachable tool connector (135) is detachably connected to the exterior profile (120) of the ergonomic grip (105). The detachable tool connector (135) may be configured to accept the handle of a variety of paintless dent removal tools. For example, the detachable tool connector (135) may be configured to accept a handle of a paintless dent removal tool such as "push" tool that is commonly used to push dents out of the surface of a vehicle. Further, the detachable tool connector may be configured to accept an improved paintless dent removal tool, such as the improved paintless dent removal tool (200) that includes an extended, curved, or angled neck that was not previously feasible with traditional paintless dent removal tools due to the physical constraints of traditional paintless dent removal tools and user fatigue and discomfort. The handle of a traditional paintless dent removal tool may be inserted into the detachable tool connector (135) and connected thereto by any mechanism known in the art, including but not limited to, fasteners, anchors, screws, pins, bolts, covers, latches, locks or the like. Once the paintless dent removal tool is secured into place by means of the detachable tool connector (135), a user may apply pressure to the ergonomic grip (105) and manipulate the paintless dent removal tool using increased leverage and improved grip. Thereby, increasing the safety of the paintless dent removal tool being used and increasing the efficiency and safety of the paintless dent repair process.

The detachable tool connector (135) may be constructed from any material of sufficient strength necessary to maintain the structural integrity of the handle assembly (100) and the paintless dent repair tool (200) when in use. For example, the detachable tool connector (135) may be constructed from non-metals such as plastics, rubber, polycarbonate, impact resistant nylon, carbon fiber, polymers, resins, ceramics, composite materials and the like or metals and alloys, including steel, titanium, iron, combinations thereof and the like. Further, it should be understood that the various components of the detachable tool connector (135) may each be constructed from the same or different materials, combinations thereof and the like.

The detachable tool connector (135) is shown as having a generally circular shape. It should be understood, however, that the detachable tool connector (135) may have any desired shape, including but not limited to, a generally square or triangular shape, for example. Further, each component of the detachable tool connector (135) may have the same or different shape, including but not limited to a circular, triangular or rectangular shape for example.

The handle assembly (100) further includes an adjustable paddle (140). The adjustable paddle (140) is detachably connected to the bottom (115) of the ergonomic grip (105). The adjustable paddle (140) has a blade (145), a shaft (150) and a tip (155). The blade (145) is configured to support a user's forearm during use and the tip (155) is detachably connected to the bottom (115) of the ergonomic grip (105). The blade (145) is shown as having a fan shape sufficient to support the forearm and elbow of a user. The blade (145) is configured to provide a user with increased leverage and support when applying pressure to the ergonomic grip (105) to manipulate the paintless dent removal tool (200). In some embodiments, the blade (145) may be telescopically extended to a deployed position and telescopically retracted to a stowed position, so as to permit a user to manually adjust the length of the blade (145) to fit the size and shape of a particular user. In this way, the handle assembly (100) provides for increased comfort and improved safety during use. Thereby, increasing the safety and efficiency of the paintless dent repair process.

The adjustable paddle (140) may be constructed from any material of sufficient strength necessary to maintain the structural integrity of the handle assembly (100) and the paintless dent repair tool (200) when in use. For example, the adjustable paddle (140) may be constructed from non-metals such as plastics, rubber, polycarbonate, impact resistant nylon, carbon fiber, polymers, resins, ceramics, composite materials and the like or metals and alloys, including steel, titanium, iron, combinations thereof and the like. Further, it should be understood that the various components of the adjustable paddle (140) may each be constructed from the same or different materials, combinations thereof and the like. In some embodiments, the adjustable paddle (140) may also include ribs, rods or bracing structures for additional strength.

The adjustable paddle (140) is shown as having a generally rectangular shape. It should be understood, however, that the adjustable paddle (140) may have any desired shape, including but not limited to, a generally square or circular shape, for example. Further, each component of the adjustable paddle (140) may have the same or different shape, including but not limited to a circular, triangular or rectangular shape for example.

The method (300) includes the step of connecting (310) a paintless dent removal tool (200) to the detachable tool connector (135) of the handle assembly (100). The handle assembly (100) is configured to accept a portion of the handle of the dent removal tool (200) into the detachable tool connector (135). The detachable tool connector (135) configured to lock the handle of the paintless dent removal tool (200) into position.

The method (300) further includes the step of using (315) the paintless dent removal tool (100) to remove a dent (192) from the surface of a vehicle body. The paintless dent removal tool (200) may be used to "push-out" a dent from the inside outward or "pull-out" a dent from the outside of the vehicle body. Once the dent is pushed or pulled out, there may also be a need to partially "knock-down" or flatten the dent to smooth-out the outer surface of the vehicle body to completely remove the dent.

The handle assembly (100) is configured to reduce fatigue and strain on the wrist, increase the force being applied by a person, increase the control of the force being applied, provide for adjustments for user size and angle and is adapted for use with a wide variety of paintless dent removal tools, including, but not limited to paintless dent removal tool (200) depicted in FIG. 4. Thereby, increasing the safety and effectiveness of the paintless dent repair process and reducing the cost of the paintless dent repair process.

It is to be appreciated that embodiments of the inventive concepts disclosed herein may be shipped fully or partially assembled, or fully or partially disassembled in the form of a kit, as will be readily appreciated by persons of ordinary skill in the art having the benefit of the instant disclosure.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the broad scope of the inventive concepts disclosed herein and defined by the appended claims.

What is claimed is:

1. A paintless dent removal system comprising:

a paintless dent removal tool handle assembly comprising:

an ergonomic grip having a top, a bottom, an opening extending therethrough, and an exterior profile, wherein at least a portion of the exterior profile of the ergonomic grip comprises one or more depressions spatially arranged in a series along a portion of the exterior profile of the ergonomic grip and configured to be gripped by a person;

a detachable paintless dent removal tool connector for detachably connecting a paintless dent removal tool to the handle assembly, the detachable paintless dent removal tool connector detachably connected to the exterior profile of the ergonomic grip such that the detachable paintless dent removal tool connector extends at least partially through the opening of the ergonomic grip;

an adjustable paddle detachably connected to the bottom of the ergonomic grip and capable of rotating about the ergonomic grip, the adjustable paddle having a blade, a shaft and a tip, the blade configured to support a user's forearm during use of a paintless dent removal tool and the tip detachably connected to the bottom of the ergonomic grip; and a detachable paintless dent removal tool selected from a plurality of different types of paintless dent removal tools, the paintless dent removal tool detachably connected to the detachable paintless dent removal tool connector of the handle assembly.

2. A method of removing a dent from a vehicle, the method comprising the steps of:

providing a paintless dent removal system comprising:

a paintless dent removal tool handle assembly comprising:

an ergonomic grip having a top, a bottom, an opening extending therethrough, and an exterior profile, wherein at least a portion of the exterior profile of the ergonomic grip comprises one or more depressions spatially arranged in a series along a portion of the exterior profile of the ergonomic grip and configured to be gripped by a person;

a detachable paintless dent removal tool connector for detachably connecting a paintless dent removal tool to the handle assembly, the detachable paintless dent removal tool connector detachably connected to the exterior profile of the ergonomic grip such that the detachable paintless dent removal tool connector extends at least partially through the opening of the ergonomic grip;

an adjustable paddle detachably connected to the bottom of the ergonomic grip and capable of rotating about the ergonomic grip, the adjustable paddle having a blade, a shaft and a tip, the blade configured to support a user's forearm during use of a paintless dent removal tool and the tip detachably connected to the bottom of the ergonomic grip; and a detachable paintless dent removal tool selected from a plurality of different types of paintless dent removal tools, the paintless dent removal tool detachably connected to the detachable paintless dent removal tool connector of the handle assembly; and using the paintless dent removal tool to remove a dent from the surface of a vehicle body.

* * * * *